US007866713B2

(12) United States Patent
Chen

(10) Patent No.: US 7,866,713 B2
(45) Date of Patent: Jan. 11, 2011

(54) LOCKER STRUCTURE

(76) Inventor: Te-Ming Chen, No. 18, Lane 91, Kuei Jen Rd., Pintung City (TW)

( * ) Notice: Subject to any disclaimer, the term of this patent is extended or adjusted under 35 U.S.C. 154(b) by 17 days.

(21) Appl. No.: 12/198,903

(22) Filed: Aug. 27, 2008

(65) Prior Publication Data

US 2010/0052339 A1 Mar. 4, 2010

(51) Int. Cl.
*E05B 15/00* (2006.01)
*E05C 19/00* (2006.01)

(52) U.S. Cl. ..... 292/244; 292/165; 292/252; 292/332; 70/107; 70/150; 70/467

(58) Field of Classification Search ..... 292/163, 292/165, 244, 252, 332, 335; 70/107, 144, 70/150, 152, 467, 486
See application file for complete search history.

(56) References Cited

U.S. PATENT DOCUMENTS 7,603,880 B2 * 10/2009 Chen ..... 70/107
2004/0089033 A1 * 5/2004 Lu ..... 70/107
2007/0114800 A1 * 5/2007 Kuo ..... 292/244
2008/0011029 A1 * 1/2008 Chen ..... 70/107
2009/0145179 A1 * 6/2009 Chen ..... 70/107

* cited by examiner

*Primary Examiner*—Carlos Lugo
(74) *Attorney, Agent, or Firm*—Leong C. Lei

(57) ABSTRACT

A locker structure is disclosed. The structure comprises a housing, latch, bolt, sliding member triggering rod, positioned within the housing, wherein the sliding member has a bottom edge provided with a slot holding a spring and a steel bead such that the sliding member moves to urge at the bolt or disconnected from the bolt form a locking state and the handle cannot be opened, or open the locker via an external handle, the sliding member is provided with a securing hole to lock with a body plate having a vertical long slot, and a spring and steel beads are provided between the plate body and the sliding member such that the plate body can be triggered to slide up and down by means of the long hole so as to change the urging position of the triggering rod and the triangular latch can change into different position adaptable to door opening at the left and right side.

1 Claim, 5 Drawing Sheets

LOCKER STRUCTURE

TECHNICAL FIELD OF THE INVENTION

The present invention relates to locker structure, and in particular, a locker structure which allows the locking and unlocking of an external handle and the locker is adapted to suit left and right door

DESCRIPTION OF THE PRIOR ART

Generally, the lockers used in apartments corridors comprise conventional large latch, triangular latch or small latch, and also comprises a locking bolt interlinked to the small latch. Under normal condition, the inner handle is rotated to open the door, the locker is then locked. Thus, the external handle cannot be opened, and a key is needed to rotate the core of the locker. Thus, the user before rotates the handle, the bolt of the small latch has to be pressed such that the locker is maintained at an open state. This is very troublesome and if a key is not brought together with the user, he may not be able to re-enter via the door. Generally, when the locker is secured at the left side and it wants to be changed to position on the right or from right to the left, there is no easy way of adjusting or modified, which cause problem to the user.

Accordingly, it is an object of the invention to provide a locker structure which can mitigate the above drawbacks.

SUMMARY OF THE INVENTION

An object of the present invention is to provide a locker structure which allows the locking and unlocking of the external handle, and to suit the left or right side door.

A further object of the present invention is to provide a locker structure comprising a housing, latch, bolt, sliding member triggering rod, positioned within the housing, wherein the sliding member has a bottom edge provided with a slot holding a spring and a steel bead such that the sliding member moves to urge at the bolt or disconnected from the bolt form a locking state and the handle cannot be opened, or open the locker via an external handle, the sliding member is provided with a securing hole to lock with a body plate having a vertical long slot, and a spring and steel beads are provided between the plate body and the sliding member such that the plate body can be triggered to slide up and down by means of the long hole so as to change the urging position of the triggering rod and the triangular latch can change into different position adaptable to door opening at the left and right side.

Yet a further object of the present invention is to provide a locker structure, wherein the housing at the position of the sliding member is provided with spaced apart through holes such that the sliding member sides internally or externally, the steel bead at the bottom edge of the sliding member is engaged at different through hole so as to form a positioning for the sliding member.

Still a further object of the present invention is to provide a locker structure, wherein the sliding member is provided with a securing long hole and the two sides of the securing long hole are respectively provided with a slot such that the vertical long hole and the plate body of the slot are locked at the securing hole, and the slot between the plate body and the sliding member are provided with spring and steel bead such that the plate body is allowed to slide up and down along the long hole so as to change the urging position of the triggered rod and the triangular latch is allowed to change its direction to suit the left open or right open door.

Other objects, and advantages will become more apparent in view of the following detailed description in conjunction with the accompanying drawings.

DETAILED DESCRIPTION OF THE PREFERRED EMBODIMENTS

Figure 1:
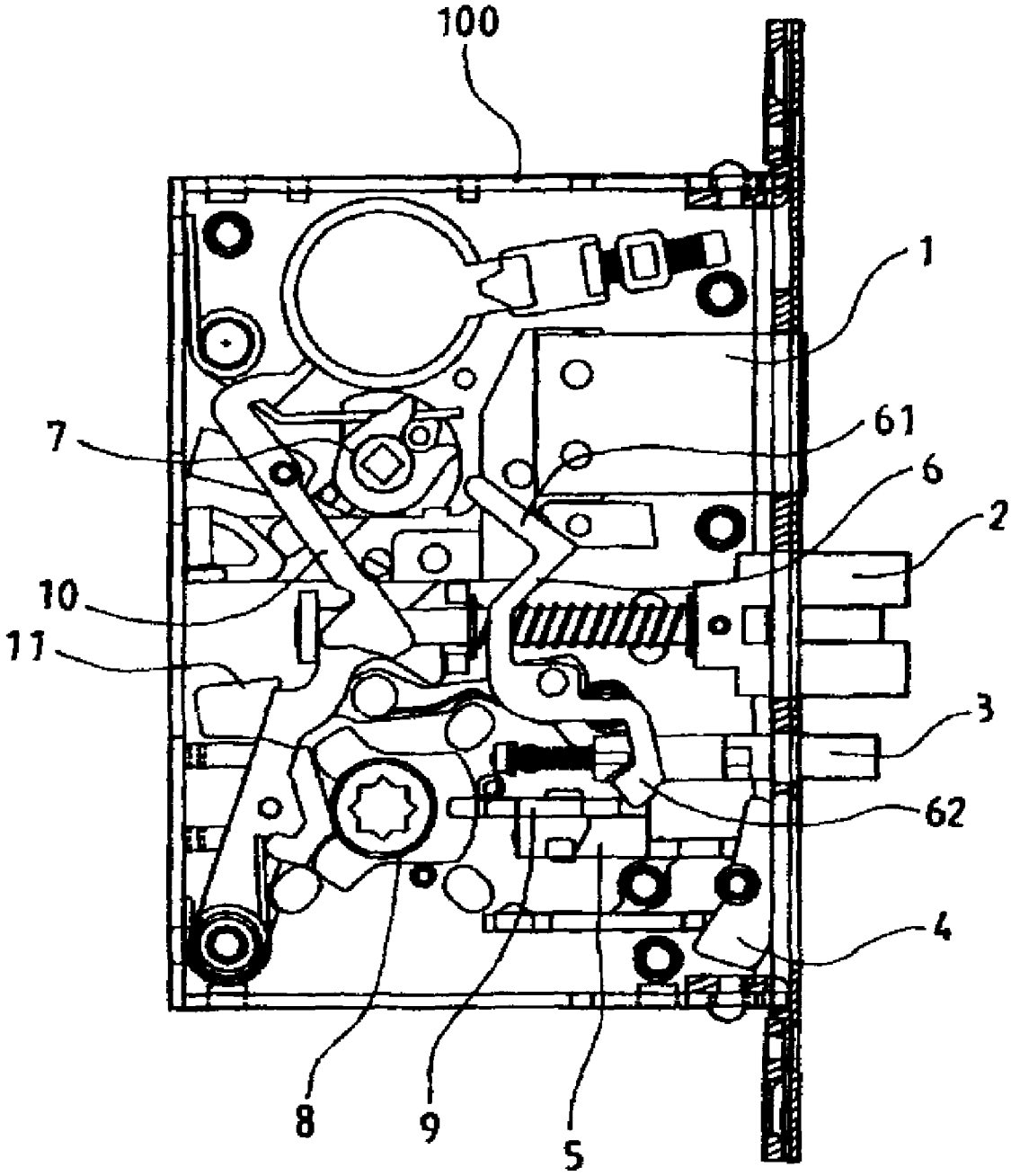
FIG. 1 shows the structure of the locker of the present invention.
Figure 2:
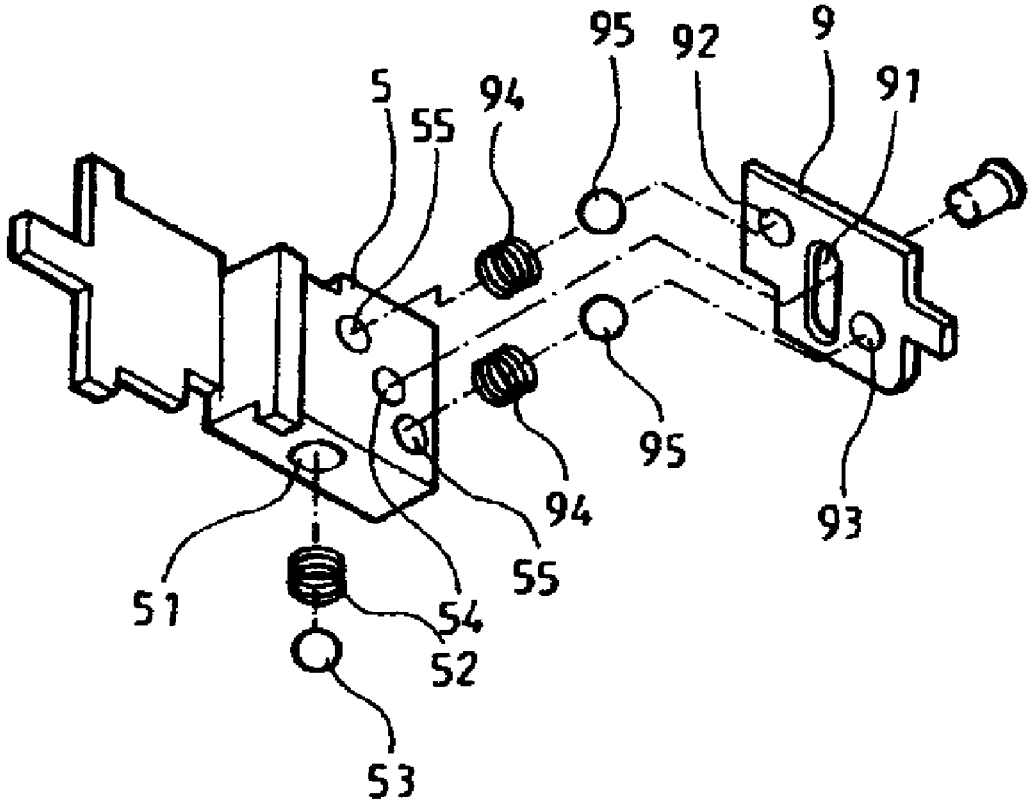
FIG. 2 shows an exploded perspective view of the locker structure of the present invention.
Figure 3:
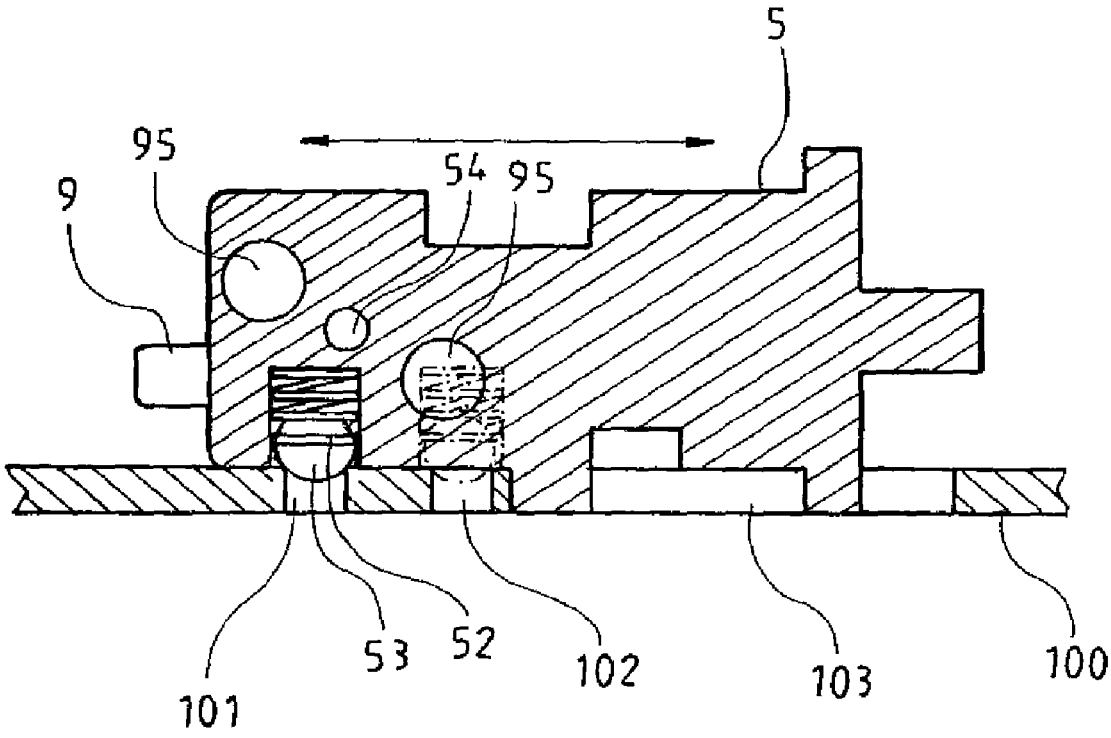
FIG. 3 is a sectional view showing the sliding module mounted within the housing of the locker structure of the present invention.

Referring to FIGS. 1 to 3, there is shown a locker structure comprising sliding module mounted within a housing. As shown in the drawing, the locker has a housing 100 which contains conventional large latch 1, a triangular latch 2, a small latch 3, a bolt 4, a sliding member 5, a trigger rod 6, a core axle 7, a handle axle 8 and a swing rod 10 positioned next to the handle axle 8, a hooking rod 11 at the lower section of the triangular latch 2, wherein the housing 100 is at position of the sliding member 5 and is provided with arranged spaced apart through holes 101, 102, and at the position of one side of the triangular latch 2, an opening 103 is provided.

The bottom edge of the sliding member 5 has a slot 51 which holds a spring 52 and a steel bead 53 such that the sliding of the housing 100 will be positioned by the steel bead 53 being engaged with the different through hole 101, 102 of the housing 100. The surface of the sliding member 5 is provided with a securing hole 54 and the two lateral sides of the securing hole 54 are provided with symmetrical slots 55.

The plate body 9 is provided with a vertical long hole 91, and the two lateral sides of the long hole 91 are provided with slots 92, 93 such that the plate body 9 is secured to the securing hole 54 of the sliding member 5 with its long hole 91 and is adhered to the sliding member 5, and between the symmetrical slots 55 of the sliding member 5 and the plate body 9 of the slots 92, 93, a spring 94 and steel bead 95 are provided such that the plate body 9 slides by its long hole 91 along the sliding member 5 so as to change the urging position of the trigger rod 6 and the triangular latch 2 can change to a different direction to fit left open or right open door. And when the triangular latch 2 has changed to a different direction, the opening 103 at one lateral side of the housing 100 facilitates the control of the plate body 9 to slide up and down of the sliding member 5.

The trigger rod 6 has a hook section 61 at the lower section and the hook section 61 is upward extended to an urging section 62, and between the hook section 61 and the urging section 62, a positioning hole is provided for the mounting of the housing 100.

The combination of all the components forms into the locker structure in accordance with the present invention. When the interior rotating button rotates the core axle 7 so as to drive the large latch 1 and the trigger rod 6, the sliding member 5 is triggered so as to engage with the handle axle 8 to form into a locking state and the external handle cannot be opened. When the inner handle is depressed the handle axle 8 is triggered and the swing rod 10 pushes away the hook rod 11 and the core axle 7, and the large latch 1 and the triangular latch 2 to rotate. At the same time, the sliding member 5 is moved externally to cause a locker open state to allow the opening of the external handle so that the application of the locker structure is convenient and simple. The position of the sliding member 5 is provided with through holes 101, 102 so that when the sliding member 5 is moved internally or externally, the steel bead 53 will engage with one through hole 101, but due to the elasticity of the spring 52, the steel bead 53 retracts to the slot 51 and is then slid to another through hole 102 so that the steel bead 53 is engaged with the through hole 102 and the sliding member 5 is positioned.

Figure 4:
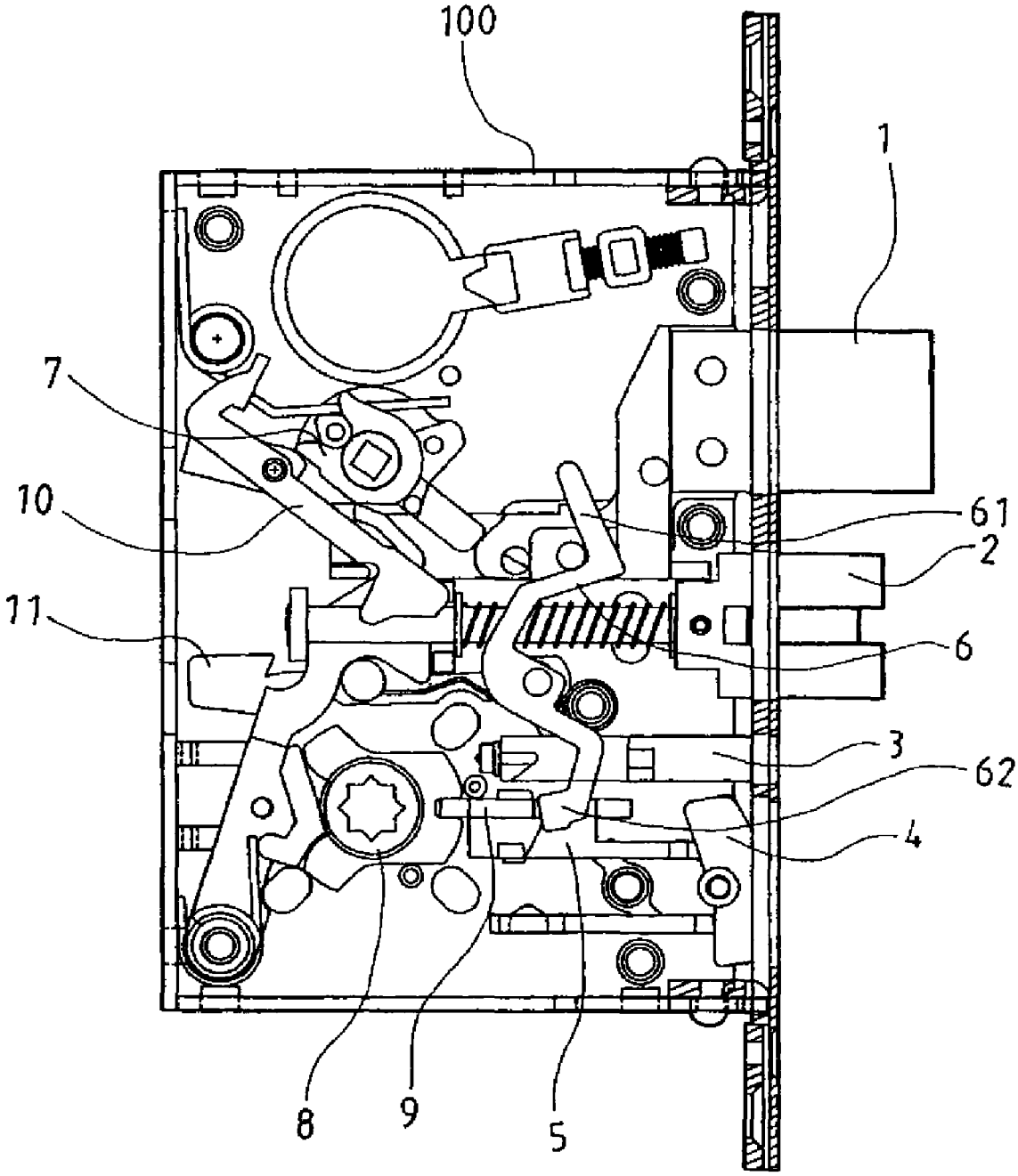
FIG. 4 shows the locking of the locker structure of the present invention.

Referring to FIG. 4, which shows the locking position of the locker structure. When the interior button rotates the core axle 7, the large latch 1 is driven externally, and at the same time, the trigger rod 6 is driven. The trigger rod 6 pushes the sliding member 5 to move inward and is engaged with the notch on the handle axle 8 to form into a locking state. Thus, the external handle 8 is engaged and the open of the locker externally is not possible.

Figure 5:
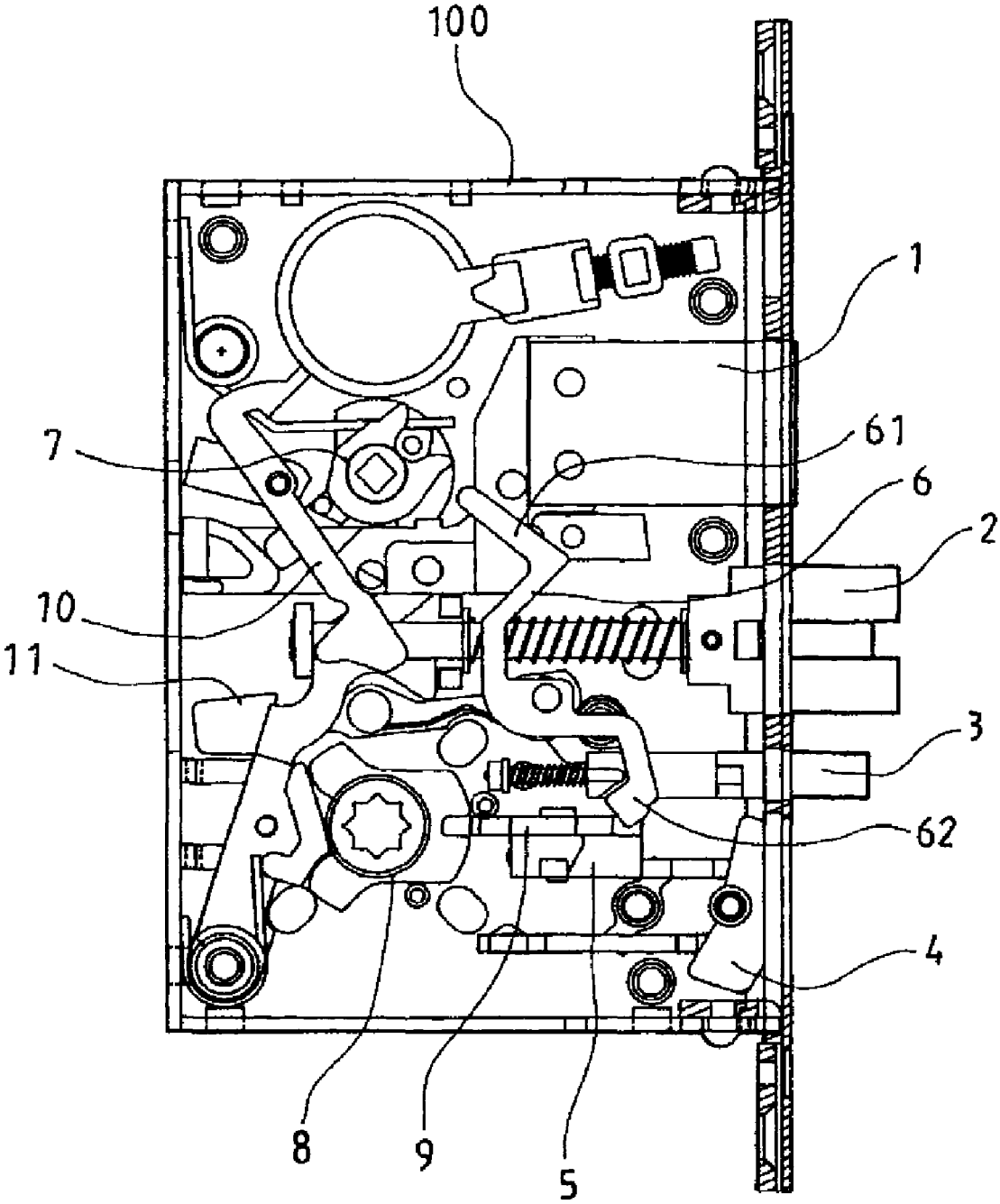
FIG. 5 shows the unlocking of the locker structure of the present invention.

Referring to FIG. 5, there is shown the unlocking of the locker structure of the present invention. When the inner handle is depressed, the handle axle 8 is rotated in a reverse direction and the swing rod 10 pushes away the hook rod 11 and the core axle 7. Thus, the large latch 1 and the triangular latch 2 are retracted. When the large latch is retracted, at the same time, the trigger rod 6 change with a different angle so as to push away the sliding member 5 to move externally to form into the opening or unlocking of the locker, and allow other people to open freely. Thus, the locker in applicable is conveniently used.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A locker structure comprising:

a housing having two through holes;

a large latch arranged within said housing;

a triangular latch arranged within said housing;

a small latch arranged within said housing;

a trigger rod having a lower section provided with a hook section and an upper section provided with an urging section, said trigger rod having a positioning hole between said hook section and said urging section for mounting with said housing;

a sliding member having a bottom edge provided with a slot which holds a spring and a steel bead so that sliding of said housing will be positioned by said steel bead being engaged with one of said through holes of said housing, said sliding member having a surface provided with a securing hole, two lateral sides of said securing hole being provided with symmetrical slots;

a plate body having a vertical long hole, two lateral sides of said long hole being each provided with a slot so that said plate body is secured to said securing hole of said sliding member with said long hole, a spring and a bead being provided between said symmetrical slots of said sliding member and said slots of said plate body so that said plate body slides by said long hole along said sliding member so as to change urging position of said trigger rod thereby enabling said triangular latch to change to a different direction to fit left open or right open door;

a core axle drivingly connected with said large latch and said hook section of said trigger so that when said core axle is rotated to drive said large latch and said trigger rod, said sliding member is triggered so as to engage with said handle axle to form into a locking state; and a handle axle drivingly connected with said sliding member;

wherein when said core axle is rotated, said large latch is driven externally and said trigger is driven to push said sliding member to move inward and engage with a notch of said handle axle to form into a locking state.

* * * * *